United States Patent [19]

Stipek, Jr.

[11] 4,074,911

[45] Feb. 21, 1978

[54] TAMPER PROOF LOTTERY TICKET

[75] Inventor: Charles J. Stipek, Jr., Riverside, Ill.

[73] Assignee: Bates Printing Specialties, Inc., Cicero, Ill.

[21] Appl. No.: 689,094

[22] Filed: May 24, 1976

[51] Int. Cl.[2] ..... B42D 15/00

[52] U.S. Cl. ..... 283/6; 283/8 R; 229/92.3; 273/139

[58] Field of Search ..... 283/6–8, 283/51, 52; 35/139; 229/92.3; 273/139

[56] References Cited

U.S. PATENT DOCUMENTS

| | | | |
|---|---|---|---|
| 3,512,780 | 5/1970 | Allison | 283/8 R X |
| 3,736,006 | 5/1973 | Polsky | 283/6 |
| 3,940,124 | 2/1976 | Johnson | 283/6 |

*Primary Examiner*—Stephen C. Pellegrino
*Attorney, Agent, or Firm*—Kinzer, Plyer, Dorn & McEachran

[57] ABSTRACT

An elongated one piece paper blank which can be folded into a ticket or coupon usable in a lottery, advertising or promotional contest, game of chance and the like. The blank, when folded and glued, forms a ticket having a front panel of generally rectangular configuration which is connected to a similar rear panel by a fold line at one edge. A smaller intermediate panel is connected by a fold line along one edge to the rear panel. The intermediate panel is adhered to both the front and rear panels to form a closed sheath. A removable rectangular panel is positioned in the sheath between the front and rear panels and extends outwardly of the panels along at least one edge thereof. The removable panel is connected to the sheath only by a connection to the intermediate panel along one of its edges which connection is an easily breakable interrupted cut line. Indicia of various types may be printed on the removable panel where it is not visible until the removable panel is separated along the interrupted cut line and removed from the sheath. In a modified ticket, a tear-out access strip is provided in one of the panels and indicia is provided on the removable panel in alignment therewith.

4 Claims, 4 Drawing Figures fig.1.
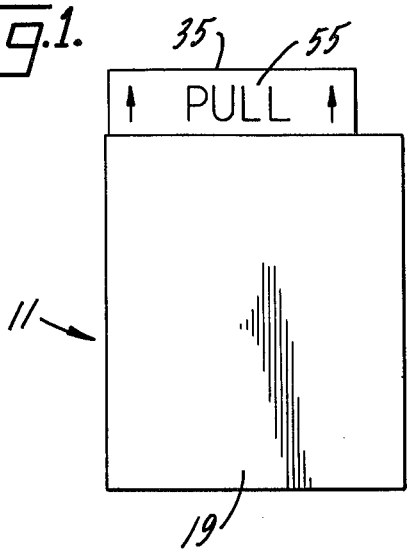
fig.2.
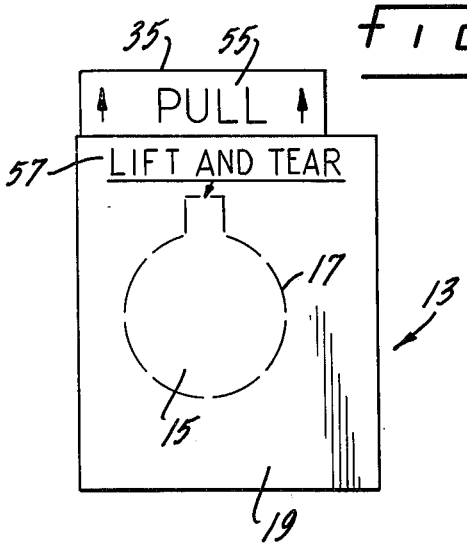
fig.3.
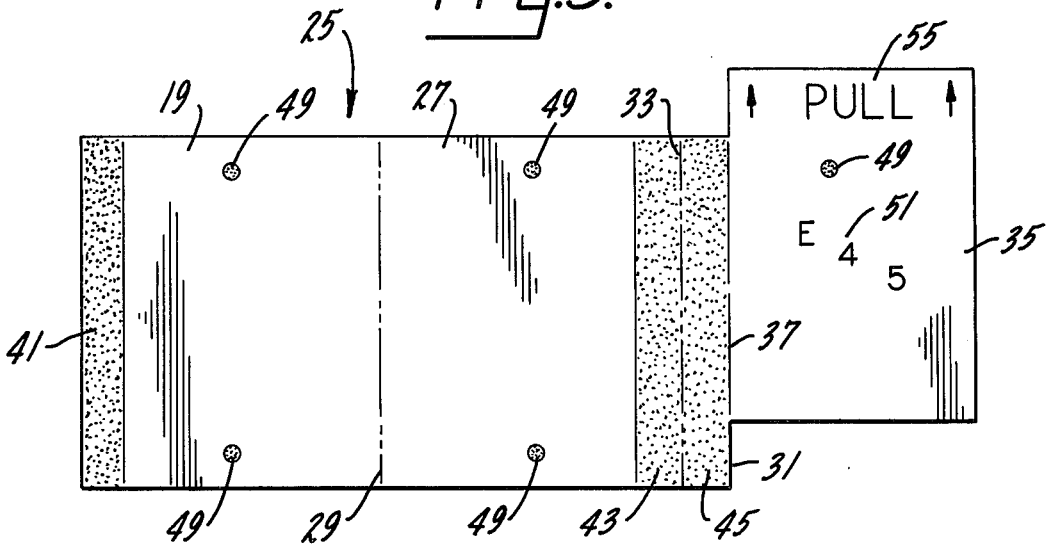
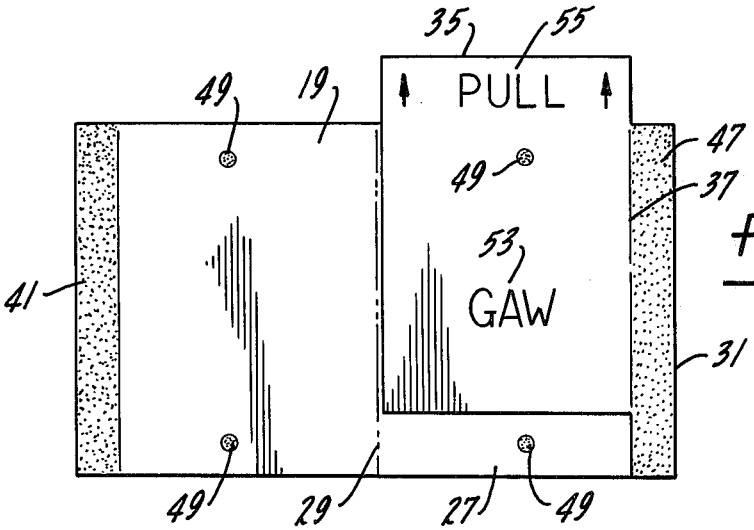
fig.4.

TAMPER PROOF LOTTERY TICKET

SUMMARY OF THE INVENTION

This invention is concerned with a tamper proof ticket or coupon usable in a lottery, advertising or promotional contest, game of chance and the like. It is particularly concerned with such a ticket or coupon of simplified construction.

An object of this invention is a one piece paper blank which may be folded into a tamper proof lottery ticket or coupon.

Another object is a lottery ticket or coupon which is simple and inexpensive to manufacture.

Another object is a lottery ticket or coupon having a tamper proof removable portion carrying concealed indicia.

Another object is a lottery ticket or coupon having an easily removable portion which resists accidental disengagement.

Other objects may be found in the following specification, claims and drawings.

BRIEF DESCRIPTION OF THE DRAWINGS

The invention is illustrated more or less diagrammatically in the following drawings wherein:

FIG. 1 is a front view of the assembled ticket or coupon of this invention;

FIG. 2 is a front view of a modified form of the ticket or coupon of this invention;

FIG. 3 is a plan view of a one piece blank for forming the ticket or coupon of this invention; and FIG. 4 is a plan view of the blank of FIG. 3 in its partially assembled condition.

DESCRIPTION OF THE PREFERRED EMBODIMENTS

FIG. 1 of the drawings shows the assembled ticket or coupon 11 of the preferred form of the invention. FIG. 2 shows a modified ticket or coupon 13 having a tearout access portion 15. This access portion may be defined by a perforated or interrupted cut line 17 formed in the front panel 19 of the ticket or coupon.

Both the ticket and coupon 11 and the modified ticket or coupon 13 may be formed from a one piece paper blank 25 of generally elongated rectangular shape. Many types and qualities of paper or paper stock may be used. A preferred type is a ten point solid bleach sulfide stock coated on one side. The paper blank includes a front panel 19 and a rear panel 27 of essentially the same size and shape with the front panel connected to the rear panel by a transverse fold line 29. An intermediate panel 31 of the same width as the panels 19 and 27 but much shorter is connected to an end edge of the rear panel 27 by a fold line 33.

A removable panel 35 also of rectangular shape but offset laterally relative to the panels 19, 27 and 31 is connected to the end edge of the intermediate panel 31 by an interrupted cut line 37. The interrupted cut line may be formed by nicks placed in the cutting die. The interrupted cut line should be strong enough to hold the removable panel 35 securely attached to the intermediate panel 31 during manufacturing and assembly operations but should permit the panel 35 to be removed from the ticket or coupon 11 or 13 by lateral pulling of the panel.

Adhesive is applied to a rectangular area 41 of the front panel 19 along one end edge thereof. The type of adhesive used may be selected in accordance with manufacturing considerations and the paper or paper stock used. Adhesive is also applied to a rectangular area 43 along an end edge of the back panel 27. The adhesive area 43 is located along the edge of the panel 27 opposite to the edge of the panel 19 having the adhesive area 41. The entire intermediate panel 31 is covered with adhesive creating a rectangular adhesive area 45. Adhesive is also applied to the entire opposite side of the panel 31 creating an adhesive area 47, shown in FIG. 4. Additional adhesive spots 49 are applied along the side edges of the front panel 19, back panel 27 and on both sides of the removable panel 35. A crystalizing glue, which is relatively easy to break, is used for this purpose.

Indicia 51, which may be in the nature of letters, numerals or both, is printed on the panel 35 in a location where it will be concealed when the ticket or coupon is in its assembled form. Indicia 53, which may also be letters, numerals or a combination thereof, is printed on the opposite side of the panel 35 where it also will be concealed when the ticket or coupon is in its assembled condition. Indicia 53 is intended for use with the modified ticket or coupon 13 of FIG. 2 and is positioned on the panel 35 so that it will be visible upon removal of the tear-out access portion 15. Indicia 55 which may be of an instructional nature such as the word "PULL" and one or more arrows is printed on the portion of the removable panel 35 which is located outwardly of the sides of the panels 19, 27, and 31 so that the indicia will be visible when the ticket or coupon is in its assembled condition. Indicia 57 of an instructional nature may be applied to the front panel 19 of the modified ticket or coupon 13. The instructions are concerned with the removal of the tear-out access portion 15.

The steps in the manufacture of the tickets or coupons 11 and 13 of this invention include the printing of the indicia 51, 53, 55 and 57 on the paper board. The printing step may proceed or be followed by the die-cutting of the paper stock into the paper blank 25. The fold lines and the interrupted cut line 37 as well as the perforated lines 17 may be formed in the next manufacturing step. This step may be followed by the application of adhesive to the adhesive areas and spots 41, 43, 45, 47 and 49. The blank is then folded about fold line 39 thereby positioning the removable panel 35 against the rear panel 27 and the intermediate panel 31 against the adhesive convered area 43 of rear panel 27. The panel 35 will extend towards but will stop short of the fold line 29 between the panels 19 and 27.

After folding, the intermediate panel 31 will be firmly secured by the adhesive to the rear panel 27 while the removable panel 35 will be attached to rear panel only by means of the crystalline adhesive spots 49. The front panel 19 is then folded about the fold line 29 so that it overlaps the removable panel 35 and the rear panel 27. The adhesive area 41 of the front panel will engage the adhesive area 47 of the intermediate panel 31 thereby firmly securing the front panel to the intermediate panel and thus to the rear panel. The crystalline glue spot 49 will somewhat weakly adhere the front panel 19 to the removable panel 35 and to the rear panel 27. The purpose of the rather easily breakable crystalline adhesive spots 49 is to prevent bending or bowing of the front and rear panels away from the removable panel 35. Such bending or bowing would allow viewing of the indicia 51 and 53 applied to the concealed portion of the removable panel 35 while the panel is still in the sheath formed by the adhered panels 19, 27 and 31.

When the ticket is in its completely assembled condition on which it is to be sold, as shown in FIG. 1, the indicia 51 on the removable panel 35 will be completely concealed. The purchaser of the ticket in order to determine whether or not the indicia 51 represents a winning number or combination of letters, will remove the removable panel 35 by following the instructions represented by the indicia 55 which informs the purchaser to pull the panel 35 outwardly. Because the removable panel 35 is held to the ticket or coupon only by the interrupted cut line 37 and the crystallized glue spot 49, lateral movement of the panel will easily remove it from the ticket sheath. The purchaser can also easily determine whether or not the ticket has been tampered with because any breaking of the crystalline glue spots 49 or the interrupted cut line 37 will be readily apparent.

The modified ticket or coupon 13, shown in FIG. 2, is particularly adapted to promotional and advertising contests in which the winning numbers or letters are selected in two stages. To determine the first stage winner and also to determine whether or not the ticket or coupon 13 will be of value in a subsequent drawing which will determine the ultimate winners, a preliminary winning number or letter or combination can be indicated by the indicia 53 which will become visible by lifting and tearing the removable access portion 15. If the indicia 53 indicates a possible winning group of numbers or letters, the ticket is retained until the next drawing. If the indicia 53 indicates that the ticket will not be among the group from which the winning ticket will be selected, it can be discarded. The final determination of the winning tickets are made by the indicia 51 printed on the otherside of the removable panel 35. As previously mentioned, this can be removed only by pulling the panel 35 outwardly. Thus, the lottery ticket of this invention may be adapted to more than one type of lottery game.

I claim:

1. An elongated foldable, one piece paper blank for a ticket usable in a lottery, game of chance and the like, including:

a first panel of rectangular configuration, a second panel of rectangular configuration connected to one end edge of the first panel by a fold line, said second panel having substantially the same dimensions as said first panel, a third panel of rectangular configuration connected to the opposite end edge of said second panel by a fold line, said third panel having a length less than that of said first or second panels, a fourth panel of rectangular configuration connected to the opposite end edge of said third panel by an easily breakable interrupted cut line, said fourth panel having approximately the same width as said first, second and third panels and a length greater than that of said third panel but less than that of either said first and second panels with said fourth panel being offset laterally relative to said first, second and third panels, said third and fourth panels being foldable about said fold line between said second and third panels to position the third and fourth panels against said second panel with a portion of said fourth panel extending laterally of said second panel, said first panel being foldable about its fold line with said second panel to extend over said second and said folded third and fourth panels, and adhesive means permanently fastening said third panel to said second panel and said first panel to said third panel.

2. The elongated foldable, one piece paper blank of claim 1 in which tear lines defining a tear strip are formed in said first panel.

3. A paper ticket for use in a lottery, a game of chance and the like, including:

a front panel of generally rectangular configuration, a rear panel of substantially the same size and configuration as the front panel, said rear panel being folded over to face the front panel and being integrally connected to the front panel along one edge by a fold line, an intermediate panel positioned between said facing front and rear panels and integrally connected to said rear panel along one edge by a fold line, said intermediate panel extending towards but terminating short of said fold line connecting said front and rear panelswith said intermediate panel adhesively fastened to said front panel and said rear panel, and a removable panel positioned between said facing front and rear panels and extending outwardly of the periphery of said panels along at least one edge thereof, said removable panel being connected to said intermediate panel along one edge thereof by an easily breakable interrupted cut line.

4. The paper ticket of claim 3 in which tear lines defining a tear strip are formed in said front panel.

* * * * *